United States Patent [19]

Bittner et al.

[11] Patent Number: 4,504,051

[45] Date of Patent: Mar. 12, 1985

[54] CONTINUOUS FORMS REFOLDER FOR HIGH SPEED PRINTERS

[75] Inventors: John R. Bittner; Harry R. Berrey; Ralph S. Billings, all of Waynesboro, Va.

[73] Assignee: Genicom Corporation, Waynesboro, Va.

[21] Appl. No.: 29,390

[22] Filed: Apr. 12, 1979

[51] Int. Cl.[3] ..... B41L 1/30

[52] U.S. Cl. ..... 270/40; 226/45

[58] Field of Search ..... 270/61 F, 31, 39–40, 270/73, 79, 61 R, 82, 85; 226/24, 45

[56] References Cited

U.S. PATENT DOCUMENTS

| | | | |
|---|---|---|---|
| 3,195,883 | 7/1965 | Southwell et al. | 270/79 |
| 3,342,390 | 9/1967 | Winterbottom et al. | 226/45 |
| 3,363,895 | 1/1968 | Abe et al. | 270/61 F |
| 3,829,080 | 8/1974 | Braen et al. | 270/61 F |
| 3,927,874 | 12/1975 | Buisman | 270/61 F |
| 4,030,720 | 6/1977 | Jones | 270/61 F |
| 4,095,779 | 6/1978 | Imagi et al. | 270/61 F |
| 4,172,592 | 10/1979 | Mueller | 270/79 |

FOREIGN PATENT DOCUMENTS

| | | | |
|---|---|---|---|
| 2435054 | 2/1976 | Fed. Rep. of Germany | 270/61 F |

*Primary Examiner*—A. H. Eickholt

*Attorney, Agent, or Firm*—Cushman, Darby & Cushman

[57] ABSTRACT

Refolder for a fan-folded web which automatically adjusts the height of the area in which refolding takes place to accommodate different speeds of movement and volume of fan-folded paper.

7 Claims, 12 Drawing Figures

CONTINUOUS FORMS REFOLDER FOR HIGH SPEED PRINTERS

BACKGROUND OF THE INVENTION

This invention relates to refolding fan-folded webs into a stack and, in particular, to refolding fan-folded paper from a high speed printer.

In data processing and communication applications, high speed printers are used to print the rapidly generated output of data processing machines. The medium on which printing generally is performed is "fan-folded", that is elongated webs having transversely extending folds longitudinally spaced with alternate folds pointing in opposite directions. The web is taken into the printer from a stack within which it is tightly folded at the spaced folds. In the course of printing, the web is unfolded and a need exists to refold it along its folds in a zigzag manner and into a stack. The web may be a single sheet of paper or consist of several sheets of paper interspersed with carbons. It is not uncommon to print up to several sheets with carbons.

It should be noted that the output of a high speed printer is not necessarily continuous and constant. The printer may generate printout faster when printing short lines than long ones. When slewing (feeding paper without printing), the paper moves through the printer at an extremely high speed. Further, with some types of printers, paper is fed from the printer discretely and only after a line has been printed. No paper movement occurs during printing, that is, the printer's paper output is not continuous. Still other printers print continuously while the paper is moving.

Numerous machines have been designed to stack the fan-folded printout from high speed printers. Oftentimes, a pair of paper feed tractors engage edge perforations in the paper and are used to feed the paper from its incoming stack through the printing mechanism and then to the outgoing stack being formed in a storage chamber. In some instances use has been made of vacuum chambers to receive, contain or control the paper. Also, various complex designs of chutes and movable arms have been employed to stack the paper neatly without misfolding and without jamming the storage compartment or the printing and paper drive mechanisms. These prior art arrangements, however, have proved to be complex in design, expensive to construct and not capable of reliably stacking the fan-folded printout of high speed printers operating over a wide range of speeds and involving large volumes of paper. The prior art arrangements have been noticeably deficient in situations where some memory of the folds is lost during the printing operation. For example, heat and pressure in certain printing operations partially iron out the folds in the paper which can lead to misfolds.

SUMMARY OF THE INVENTION

It is the primary object of this invention to provide a fan-folded web refolder which is reliable as well as inexpensive and easily maintained.

It is a further object of this invention to provide an improved apparatus for refolding an unfolded fan-folded web into a stack over a wide range of stack heights.

It is a further object of this inVention to provide an improved refolder for a fan-folded web which automatically adjusts to accommodate different speeds and volume of fan-folded paper for stacking following printing.

It is a further object of this invention to provide an improved arrangement for refolding fan-folded paper, such as used in high speed printers, which has lost some of the memory of its folds.

In accordance with one embodiment of the invention there is provided an arrangement for stacking an elongated web, available from a source such as a high speed printer, having transversely extending folds which are longitudinally spaced with alternate folds pointing in opposite directions and wherein at least one fold of the web is properly oriented on a platform on which subsequent folds are to be stacked. There is provided a first station for receiving the web from the source, for example a high speed printer, and for driving it longitudinally toward the platform. The first station is located a given distance above the stacked web on the platform and centered between alternate folds of the web that is to be stacked on the platform. Means are provided for indicating when the top of the stacked web on the platform has reached a predetermined height. In response to such an indication, means are provided for automatically, recurrently increasing the distance between the first station and the top of the stack by a predetermined amount to enable further stacking. To avoid misfolding over a wide range of web speeds and volumes and some loss of memory of the fold as a result of the printing operation, the distance between the platform and the first station is automatically, recurrently adjusted to a predetermined distance conducive to proper refolding. In a preferred embodiment this distance was dimensioned to be substantially equal to one-half the length of the web between successive folds. This dimensioning of the spacing in combination with the longitudinal driving of the web toward the platform results in an improved refolding action.

DESCRIPTION OF THE PREFERRED EMBODIMENT

Figure 1A:
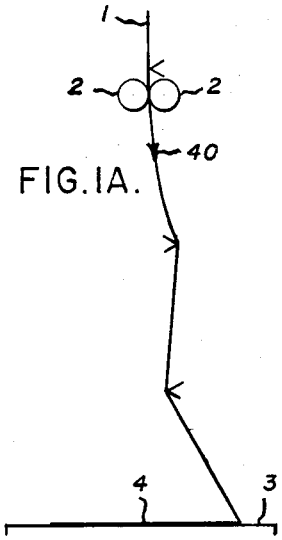
FIG. 1A illustrates graphically the undesirable situation when the paper column is too high and can fall to one side and cause misfolds or could buckle concave or convex in a horizontal direction forming a rigid beam over which successive folds tumble and misfold.

The problem that this invention is concerned with is the collecting and refolding of continuous forms as the printed forms exit from line printers at high speed. As previously mentioned, as the speed of the printer increases and the paper flow correspondingly increases and the volume of paper to be stacked grows, the opportunities for misfolding of the paper increases. The problem is further aggravated when the memory in the folds is partially erased in the course of the printing process as for example due to the application of heat or pressure. With increasing printer speed, air is trapped within the folds of the paper at a faster rate, decreasing the margin of fluffing (entrapment of air at the folds) permissible before misfolding. The fluffing is undesirable since it causes curvature upward (within 2 or 3 folds) to a point where curvature build-up interferes with the material fall pattern of the paper. This is attributable in part to the reduction in space available for folding. Applicants have found that if the refolding action takes place over too great a span of paper (longitudinal web length) or over too short a span, misfolding can take place. Referring to FIG. 1A, there is illustrated the situation wherein a fan-fold web 1 arriving from a source, such as a printer, not shown, is passed between rollers 2 for refolding into a stack on platform 3. For purposes of discussion the individual folds of the web are exaggerated and noted by accompanying arrowheads. The direction of the arrows indicate the direction of the fold. The transversely extending folds are longitudinally spaced with alternate folds pointing in opposite directions. At least one fold 4 of the web is properly oriented on platform 3 on which subsequent folds are to be stacked. The rollers 2 receive the web from the undisclosed source and drive it longitudinally toward the platform in the direction of arrow 40. In the situation where the distance between the rollers and the platform is too great, the paper column can fall to one side and cause misfolds or could buckle concave or convex in the horizontal direction forming a rigid beam over which successive folds tumble and misfold.

Figure 1B:
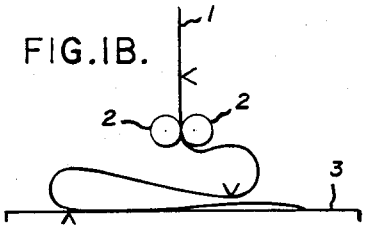
FIG. 1B illustrates graphically the situation when the paper between two successive folds instead of falling freely is caused to curve about the rollers and reach the stack at a position short of the stack edges. This situation, if permitted to continue, causes the paper to collect and jam in the rollers.

If on the other hand the distance between the rollers 2 and the platform 3, as shown in FIG. 1B, is too low, the paper between successive folds instead of falling freely is caused to curve about the rollers and reach the stack at a position short of the stack edges. If this is permitted to continue, the paper can collect and jam into the rollers 2.

The above mentioned problems become more acute in the case of printers where part of the memory of the folds is removed. Heat and pressure dry the paper and remove some of the memory from the fold increasing the likelihood of a misfold.

Figure 1C:
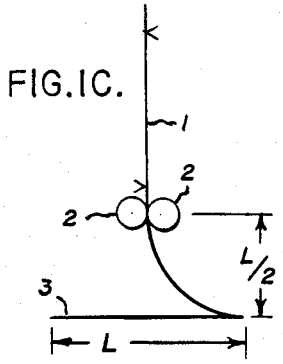
FIGS. 1C through 1G illustrate successive views of re-folding of the web is forced to take place along its transversely extending folds to the desired stack height.

The above mentioned problems are substantially minimized in accordance with the present invention. The problem of fluffing is overcome by oscillating the stack of web being collected on the platform about an axis directly below and parallel to the axis of the rollers. The problem of the paper exiting from the rollers falling to one side, buckling or not uniformly collecting on the stack is eliminated by automatically, recurrently adjusting the height between the rollers and the stack to be substantially one-half the distance between successive folds of the fan-fold paper. In the usual case, if the stack builds up in height, the location of the roller height from the top of the stack is maintained at the optimum height in response to sensor output. The result of this control action in effecting proper refolding is illustrated graphically in FIGS. 1C through 1G. After one fold of the paper is properly oriented on platform 3 as shown in FIG. 1C, subsequent folds are properly stacked as shown in successive FIGS. 1D through 1G. The driving action of the rollers forces the paper exiting from the rollers toward the platform to bend at the fold for each successive length of paper between folds. To avoid the problems of FIG. 1B, the present invention provides for a control signal to be generated upon sensing that the stack height has grown too high for proper refolding. This control signal acts to automatically, recurrently increase the separation between the top of the stack and the rollers to the optimum spacing for proper refolding. This control action continues automatically and recurrently throughout the entire refolding process.

Figure 2:
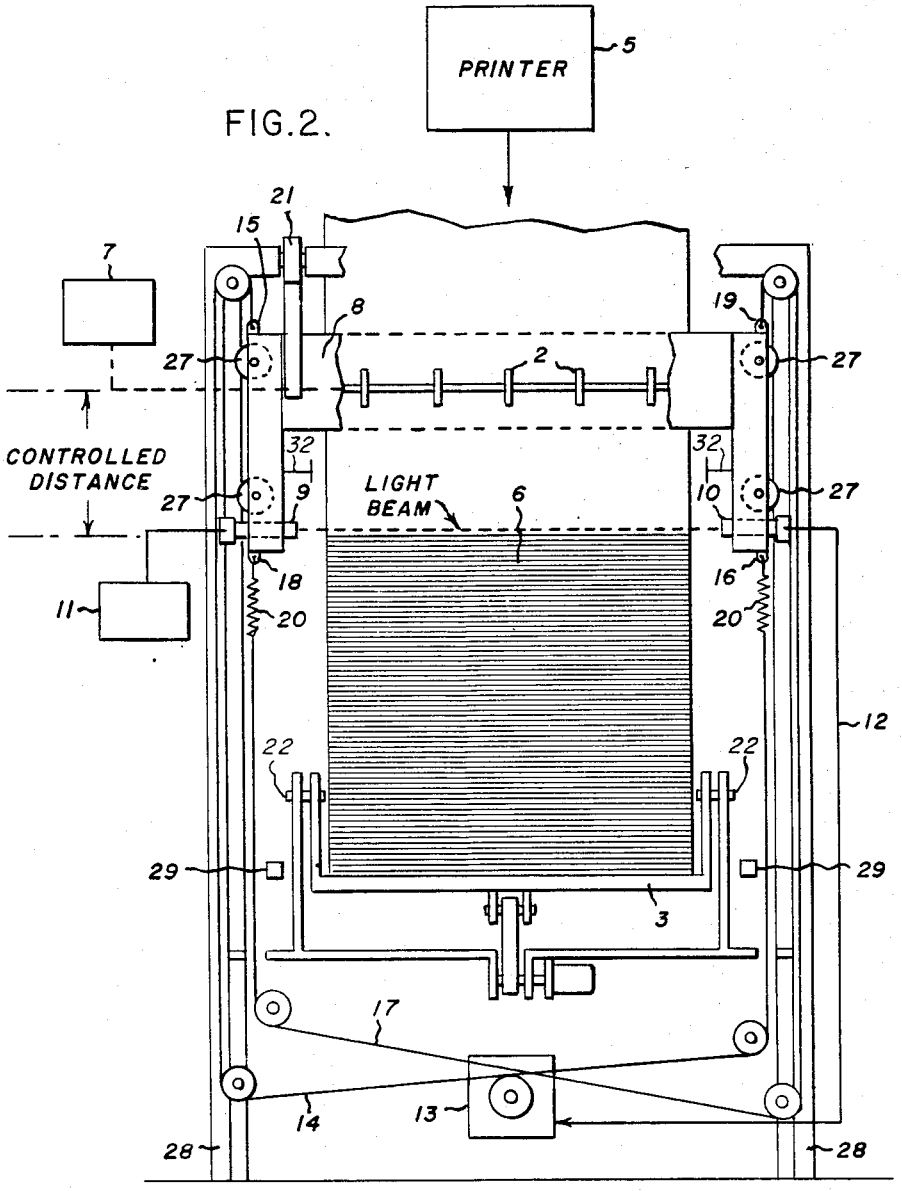
FIG. 2 illustrates in cross-section one embodiment of a refolding apparatus for obtaining the desired refolding action.

Referring to FIG. 2, there is shown a refolder in accordance with the present invention. Fan-fold paper available from a printer 5 is fed vertically through a plurality of pairs of drive rollers 2 for stacking on a platform 3. The present invention operates to cause the paper to be forced into folding along its laterally extending folds into a neat stack on the platform 3 without tumbling or misfolding as previously described. This is accomplished by monitoring the top of the stack of paper 6 and adjusting the distance between the top of the stack and where the paper exits from the rollers 2. The drive rollers for longitudinally driving the paper comprise pairs of pinch rollers 2, the rollers of any pair being mounted opposite one another and on opposite sides of the paper passing therebetween. The rollers grip and drive the paper from the printer toward the collection platform. These pinch rollers are driven by an AC electric motor 7 which operates at a constant speed, the speed being such that the linear velocity of the contact surface of the rollers is always greater than the linear velocity of the paper being delivered from the printer. This permits the refolder to be automatically adaptable to any printer slew rate up to a predetermined limit without any need to synchronize the refolder to the particular printer. It also serves to maintain tension in the span of paper between the printer and the refolder. For safety reasons and others as will be explained shortly, the pinch wheels are designed to frictionally engage the drive shaft coupled to the motor 7 so that the rollers spin against the paper when the paper is not moving. The roller system as described is mounted on an elevator 8 that contains a light source 9 and photocell sensor 10 that senses the top of the stack of forms on the platform. As previously mentioned, it has been found that reliable stacking depends on maintaining a controlled distance between the rollers and the stack of forms. This distance is maintained substantially constant by automatically, recurrently elevating the roller system in response to control signals generated by the photocell. While the distance between the rollers and the stack can be maintained constant by lowering the stack of forms away from the rollers, the advantage of the present system lies in the fact that the load presented by the elevator is constant and considerably lighter than the load presented by a full box of forms traveling on the platform. This reduces the power required since the latter case system would have to be designed to handle a full box of approximately 45 pounds even though the system would normally be operated with less than a full box of forms being collected on the platform. The light source 9 is energized from a source of power 11 whereas the output of the photocell sensor 10 is coupled over lead 12 to the capstan drive motor 13. The capstan drive motor 13 has a cable 14 engagably wrapped around its capstan drive shaft with one end of the cable connected to the top of the elevator at point 15 and the other end connected to the bottom of the elevator at point 16. To keep the parallelism of the elevator during movement under control of the capstan drive motor 13, a second cable 17 is provided having one end connected to the bottom of the elevator at point 18 and the other end to the top of the elevator at point 19. Cables 14 and 17 are driven around suitable pulleys as indicated. The capstan motor 13 is turned on and off by the photoelectric control system. In one embodiment, the capstan drive mechanism comprises a face-type friction clutch device which transmits torque from the motor to a capstan formed of urethane. The friction clutch is spring loaded to establish efficient torque capabilities to raise the elevator while limiting the maximum torque capability to enable the clutch to be overridden to permit manual resetting of the elevator in the down position. The friction drive serves also as a safety feature in that forces acting on the elevator which is accessible to an operator are limited to a safe level.

Springs 20 are provided in each of the cables for smoothing the elevator action and taking care of dimensional tolerances. In order to minimize the loads imposed on the elevator drive system, the elevator is counter-balanced with constant force springs 21.

Figure 3:
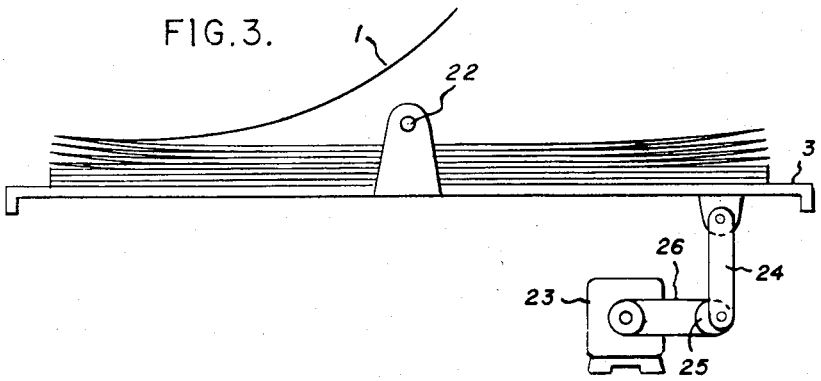
FIG. 3 illustrates the details of an oscillating platform in accordance with the invention.

It has been found that in order to refold the complete box of fan-fold paper, it is generally necessary to vibrate the stack of paper to cause the sheets to flatten out. As the stack of forms increases in height, the fluffing or curling effect at the perforations of the forms accumulates until the top of the stack will not continue to accept additional sheets. By vibrating the stack, the forms flatten out sufficiently to permit refolding of a complete box. This vibration action is achieved by pivoting the collection tray or platform 3 in the center at point 22 and rotating the tray through a small reversing angle at high speed. Referring to FIG. 3, it is seen that this motion is generated in one embodiment by an AC motor 23 driving the connecting link 24 coupled at one end to the platform 3 and the other end to the eccentric drive 25. The eccentric drive is driven by belt 26 from motor 23. The pivoting type vibration action is advantageous when coupled with the previously mentioned control of the stack height over a linear motion because the amplitude varies from 0 at the pivot point to a maximum value at the edges of the stack of forms. This causes the maximum vibration effect to be applied where most needed, that is at the edges of the stack where the folds are formed. A further advantage is that less force is required to pivot the stack than would be required to achieve linear motion thus reducing the power and structural strength requirements.

Figure 4A:
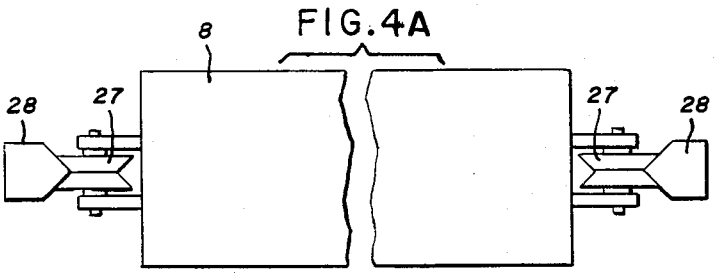
FIGS. 4A and 4B illustrate details of vertical guide rails in terms of a top view and a front view respectively.
Figure 4B:
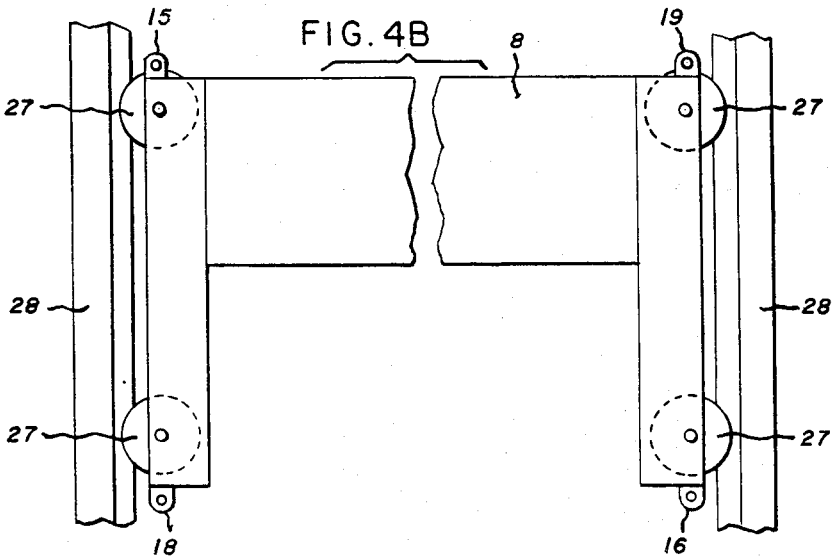

Referring to FIG. 4, there is shown a top view and front view of the guide rails and pulleys used to control the vertical movement of the elevator. Elevator 8 has the pulleys 27 attached thereto and constrained to vertical movement along the guide rails 28.

In a particular application of the present invention the length of fan-fold paper is drawn by hand past the friction rollers 2 and arranged such that at least one fold of the paper is oriented on the platform 3 (FIG. 2) on which subsequent folds are to be stacked. The elevator is manually descended until the lower ends of the elevator strike the stops 29 attached to the main frame of the refolder. In one embodiment employing 11 inch long paper (i.e. between folds), the distance between the elevator rollers and the top of the stack was selected to be substantially equal to half the length of the web between successive folds as previously described. Distances substantially in excess of this were found to result in misfolding. The photocell sensor 10 and light source 9 were mounted by vertically adjustable brackets to the elevator 8 and locked thereto by thumb screws 32. This enables the stacker to accommodate different lengths of fan-fold paper. In another application involving 11 inch paper wherein there was partial memory erasure of the fold due to heat and pressure application during the printing process, it was found that the distance between the top of the stack and the elevator was seven elevenths of L (length of paper between folds) for proper folding, particularly when the stack height was large. At smaller distances, the fluffing at the folds interfered with proper folding. Motor 7 is operated and the rollers 2 are caused to rotate. In the absence of any feeding of paper from the printer 5, the rollers slip on the fan-fold paper. When the printer is engaged and the fan-fold paper is driven longitudinally toward the rollers 2 as for example by a tractor arrangement which engages edge punched holes in the fan-fold paper, the rollers 2 pull the fan-fold paper and push it towards the platform 3. Under the previously mentioned spacing between the elevator and the platform the improved refolding action takes place as illustrated graphically in connection with FIG. 1C. As the stack of forms on platform 3 builds up to where the light source 9 is interrupted by the height of the stack, the photocell 10 operates capstan drive motor 13 to raise the elevator a predetermined distance. In a particular embodiment, this increased distance was of the order of one-half inch per elevation movement which is substantially smaller than the distance between successive folds of the fan-fold paper. Concurrently with the stacking and elevator motion, the stack of paper on the platform 3 is constantly being oscillated by motor 23 as shown in FIG. 3 to reduce the fluffing and facilitate proper stacking. In a preferred embodiment, sufficient stacking space was provided in the refolder such that a complete box of fan-fold forms could be processed by a printer and properly refolded with the previously described elevator action and vibration. If the normal stack height of a box of fan-fold paper is exceeded as for example if an operator had not removed the previous paper and just added an additional box, the elevator would continue to rise until it reached its maximum height in which case the capstan drive motor control action in response to photocell output would be disabled after a predetermined time. This constitutes no part of the present invention. Reference can be made to copending application of Eugene S. Haymes and Charles W. Spangler entitled "Stack Height Sensor and Elevator Control For a Continuous Forms Refolder", filed concurrently with this application and assigned to the same assignee, for further details of this type of operation.

Figure 5:
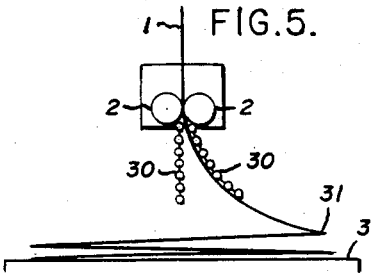
FIG. 5 illustrates the use of weights for facilitating the proper refolding of the paper web upon exiting from the drive rollers.
Figure 1D:
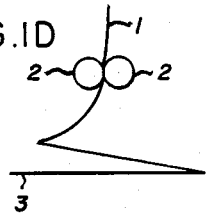
Figure 1E:
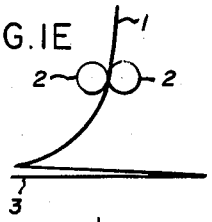
Figure 1F:
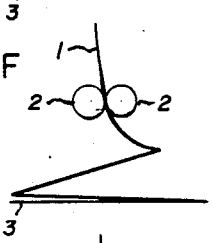
Figure 1G:
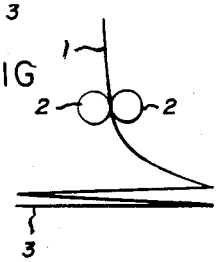

Referring to FIG. 5, there is shown a further embodiment of the present invention in which means are provided for facilitating the refolding of the fan-fold paper. As shown in FIG. 5, a plurality of gravity-flexible weights, such as weighted beads or chain links, are provided on each side of the fan-fold paper as it exits from the rollers 2. As shown in the embodiment, the action of gravity on the weights 30 operate to force the fold of paper exiting from the rollers 2 to be driven downward and to the left forcing refolding at the fold point 31. Similarly, the set of weights on the other side of the fan-fold would come into play when the paper is caused to fold towards the right. In a particular embodiment two sets of beads or chains were provided spaced apart on each side of the fan-fold paper exiting from the rollers 2.

While the invention has been described with particular reference to the construction shown in the drawings, it is understood that further modifications may be made without departing from the true spirit and scope of the invention, which is defined by the claims appended hereto.

What we claim as new and desire to secure by Letters Patent of the United States is:

1. An arrangement for refolding and stacking fanfold paper emerging from a printer, said paper having transversely extending folds which are longitudinally spaced with alternate folds pointing in opposite directions and wherein at least one fold of said paper is properly oriented on a platform on which subsequent folds are to be stacked comprising a first station for receiving said paper from said printer and for driving said received web longitudinally toward said platform for refolding and—stacking in the region between said first station and said platform, said first station located a given distance above said platform and centered between alternate folds of the paper stacked on said platform, means for indicating when the top of the stacked paper on said platform has reached a predetermined distance from said first station to produce a control signal, and means responsive to said control signal for moving said first station to increase the distance between said first station and said top of said stack by a predetermined amount for additional stacking.

2. An arrangement according to claim 1 wherein the transverse folds are equallly spaced along said paper, the length of the paper between successive folds is L, said given distance being substantially equal to L divided by 2, means for forcing the refolding of said web along its transversely extending folds comprising said predetermined amount being dimensioned to result in said given distance being re-established.

3. An arrangement for stacking a continuous web of material, available from a source, predisposed to fold in a zigzag manner wherein said web has fold lines regularly spaced theralong defining forms of a given length and wherein at least one fold of said web is properly oriented on a platform on which subsequent folds are to be stacked comprising an elevator for receiving said web from said source, said elevator located a given distance above said platform and centered between alternate folds of the web stacked on said platform, said elevator comprising means for driving said received web longitudinally toward said platform, means responsive to the top of the stacked web on said platform having reached a predetermined distance from said elevator for increasing the distance between said elevator and said top of said stack by an amount to enable further stacking.

4. An arrangement according to claim 3 wherein said amount is dimensioned to result in said given distance being reestablished.

5. An arrangement for refolding an elongated web, available from a source, having transversely extending folds which are longitudinally spaced with alternate folds pointing in opposite directions and wherein at least one fold of said elongated web is properly oriented on a platform on which subsequent folds of said web are to be stacked comprising a first station for receiving said elongated web from said source, said first station located a given distance above said platform, centered between alternate folds of the web stacked on said platform and comprising means for driving said received web longitudinally toward said platform for refolding and stacking on the platform in the region between said first station and said platform, means for sensing when the top of the stacked web on said platform has reached a predetermined distance from said first station to produce a control signal, means responsive to said control signal for increasing the distance between said first station and said top of said stack by a predetermined amount for additional stacking, and means for vibrating the stack of web on said platform during refolding.

6. An arrangement for refolding an elongated web, available from a source, having transversely extending folds which are longitudinally spaced with alternate folds pointing in opposite directins and wherein at least one fold of said elongated web is properly oriented on a platform on which subsequent folds of said web are to stacked comprising a first station for receiving said elongated web from said source, said first station located a given distance above said platform, centered between alternate folds of the web stacked on said platform and comprising means for driving said received web longitudinally toward said platform for refolding and stacking on the platform in the region between said first station and said platform, means for sensing when the top of the stacked web on said platform has reached a predetermined distance from said first station to produce a control signal, means responsive to said control signal for increasing the distance between said first station and said top of said stack by a predetermined amount for additional stacking, and means for oscillating the stack fo web on said platform about an axis substantially midway between and parallel to the folded web edges of said stack.

7. An arrangement for refolding an elongated web, available from a source, having transversely extending folds which are longitudinally spaced with alternate folds pointing in opposite directions and wherein at least one fold of said elongated web is properly oriented on a platform on which subsequent folds of said web are to be stacked comprising a first station for receiving said elongated web from said source, said first station located a given distance above said platform, centered between alternate folds of the web stacked on said platform and comprising means for driving said received web longitudinally toward said platform for refolding and stacking on the platform in the region between said first station and said platform, means for sensing when the top of the stacked web on said platform has reached a predetermined distance from said first station to produce a control signal, means responsive to said control signal for increasing the distance between said first station and said top of said stack by a predetermined amount for additional stacking, and means to assist in the refolding of said web, said last named means comprising suspended gravity flexible weights positioned to physically contact said longitudinally driven web on its journey to the platform and restrain the horizontal component of movement of said web.

* * * * *